United States Patent [19]

Stevens et al.

[11] 4,318,956

[45] Mar. 9, 1982

[54] SOIL RELEASE ON POLYESTER TEXTILES USING CATIONIC WATER SOLUBLE ADDITION POLYMER

[75] Inventors: Travis E. Stevens, Ambler; Martha H. Wolfersberger, Perkasie, both of Pa.

[73] Assignee: Rohm and Haas Company, Philadelphia, Pa.

[21] Appl. No.: 178,326

[22] Filed: Aug. 15, 1980

[51] Int. Cl.[3] ..... B05D 3/02; B32B 7/00; B32B 27/00; D06M 15/12

[52] U.S. Cl. ..... 428/265; 8/495; 427/393.4; 428/288; 428/290; 524/555; 524/812

[58] Field of Search ..... 427/393.4; 428/265, 428/288, 290; 260/29.6 TA, 29.6 SQ, 29.6 H; 8/495

[56] References Cited

U.S. PATENT DOCUMENTS

| | | | |
|---|---|---|---|
| 2,138,763 | 11/1938 | Graves . | |
| 2,744,884 | 5/1956 | de Benneville . | |
| 2,832,800 | 4/1958 | Specht et al. . | |
| 2,838,397 | 6/1958 | Grantfest et al. . | |
| 2,940,872 | 6/1960 | Gusman et al. . | |
| 2,982,682 | 5/1961 | Matlin et al. . | |
| 2,990,403 | 6/1961 | Geshan et al. . | |
| 3,078,185 | 2/1963 | Kine et al. . | |
| 3,377,249 | 4/1968 | Marco . | |
| 3,404,114 | 10/1968 | Snyder et al. . | |
| 3,467,612 | 9/1969 | Gagliardi | 427/393.4 X |
| 3,540,835 | 11/1970 | Marco . | |
| 3,592,686 | 7/1971 | Barber et al. | 427/393.4 X |
| 4,081,383 | 3/1978 | Warburton et al. | 427/393.4 X |
| 4,203,859 | 5/1980 | Kine et al. . | |

OTHER PUBLICATIONS

Chemical Abstracts, vol. 72, 1970-91449d-*Perfluoroalkglaminoethyl Methacrylate Polymers for Soil-Repellent Textiles.*

Chemical Abstracts, vol. 72, 1970-101670k-*Chemistry of Polymeric Acrylates in Soil Release Finishing.*

Bille, Dr. Heinz et al., *Chemistry of Polymeric Acrylates in Soil Release Finishing,* Melliand Texfiber, 1970, 51 (31, 330-334 (Ger.).

Chemical Abstracts, vol. 73, 1970-78367b-*Acrylic Soil-Release Agent for Textiles.*

Chemical Abstracts, vol. 74, 1971-14165x, *Dirt-Repelling Coatings for Textiles.*

*Primary Examiner*—Michael R. Lusignan

[57] ABSTRACT

A procedure is disclosed for preparing polyester fabrics having improved soil release properties. Polyester textiles impregnated with an addition polymer containing free amine groups or salts thereof are cured at elevated temperatures to give the improved fabric.

12 Claims, No Drawings

SOIL RELEASE ON POLYESTER TEXTILES USING CATIONIC WATER SOLUBLE ADDITION POLYMER

This invention relates to a procedure for preparing woven or knit polyester fabrics having improved soil release properties.

The invention is in a method comprising the steps of incorporating in the fabric from 0.2–10%, preferably 0.5–3% of polymer by weight on a solids basis based on fibers, from an aqueous solution of a cationic addition polymer salt or a latex in emulsion form. The polymer contains amine groups, the relative ratios of these groups to any other mer units in the polymer being such that a salt of the amine groups of the polymer, with an organic or inorganic acid, is soluble in water. By "amine" groups, or salts thereof, are meant materials of the formulas given immediately below; quaternary amine groups are excluded. The fabric is impregnated by conventional methods and the polymer therein cured at about 100° C. to 250° C. The molecular weight of the the soluble polymer on a viscosity average basis, ranges from 25,000 to 1,000,000, the preferred range being 50,000 to 600,000.

Similar polymers well-known for other uses are taught, for example, by a number of U.S. patents; these include Pat. No. 2,982,682 (bonding, e.g., polyester nonwoven fabrics with an aminoplast and a latex), Pat. No. 3,404,114 (latex adhesives), Pat. No. 2,183,763 (amine monomers and polymers thereof), Pat. No. 3,078,185 (shrinkproofing woolen textiles), Pat. No. 2,838,397 (mineral filled papers). Note also U.S. Ser. No. 684,427, filed May 7, 1976, corresponding to Belgian Pat. No. 849,233, granted June 9, 1977 (creping paper). Soil release and similar properties using unsaturated acid addition polymers is taught by U.S. Pat. Nos. 4,203,859, 3,540,835, and 3,377,249.

In its broadest aspects the polymer contains units derived from an addition polymerizable ethylenically unsaturated amine-containing monomer, typically of the formulae:

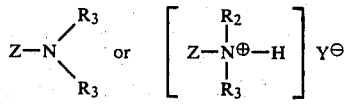

wherein $R_2$ and $R_3$ are H or lower alkyl having 1 to 4 carbon atoms, examples being methyl and tertiary butyl, or together may form a cycloaliphatic or cycloaromatic ring, examples being pyridyl, oxazoline, and the like, Y is an anion of an acid, such as a halogen ion (Cl-, Br-, or I-) or the anion of any other acid, such as nitrate, phosphate, acid phosphate, sulfate, bisulfite, methyl sulfate, carboxylate, sulfonate, sulfamate, acetate, citrate, formate, propionate, gluconate, lactate, glycolate, oxalate, acrylate, and alpha-methacryloxyacetate and Z is an addition polymer chain. Preferably, Y is the anion of an acid having an ionization constant ($pK_a$) of 5.0 or less, i.e., a dissociation such that the hydrogen ion concentration is at least $10^{-5}$.

Specific examples of preferred amine-containing monomers include dimethylaminomethyl(meth)acrylate, diethylaminoethyl(meth)acrylate, tertiary butyl aminoethyl(meth)acrylate, N-methyl diallyl amine, vinylbenzyl dimethylamine, oxazolidinyl ethyl(meth)acrylate, and aminoethyl(meth)acrylate. Other examples of the compounds to yield the amine groups are:

N-(3-dimethylamino)propyl methacrylamide
N-(beta-dimethylamino)ethyl acrylamide
N-(beta-dimethylamino)ethyl methacrylamide
10-aminodecyl vinyl ether
8-aminooctyl vinyl ether
Diethylaminohexyl methacrylate
Diethylaminoethyl vinyl ether
5-aminopentyl vinyl ether
3-aminopropyl vinyl ether
2-aminoethyl vinyl ether
2-aminobutyl vinyl ether
4-aminobutyl vinyl ether
Dimethylaminoethyl vinyl ether
N-(3,5,5-trimethylhexyl)aminoethyl vinyl ether
N-cyclohexylaminoethyl vinyl ether
N-methylaminoethyl vinyl ether
N-2-ethylhexylaminoethyl vinyl ether
Vinyl beta-dimethylaminopropionate
3-dimethylamino-2,2-dimethyl-propyl methacrylate
Methacrylate of N-hydroxyethyl-2,4,4-trimethylpyrrolidine
1-dimethylamino-2-propyl methacrylate
beta-Morpholinoethyl methacrylate
4-(beta-acryloxyethyl)-pyridine
3-(beta-methacryloxyethyl)-pyridine
beta-pyrrolidinoethyl vinyl ether
5-aminopentyl vinyl sulfide
beta-Hydroxyethylaminoethyl vinyl ether
(N-beta-hydroxyethyl-N-methyl)aminoethyl vinyl ether
Hydroxyethyldimethyl(vinyloxyethyl)ammonium hydroxide
2-vinylpyridine
3-vinylpyridine
4-vinylpyridine
2-methyl-5-vinylpyridine
5-methyl-2-vinylpyridine
4-methyl-2-vinylpyridine
2-ethyl-5-vinylpyridine
2,3,4-trimethyl-5-vinylpyridine
3,4,5,6-tetramethyl-2-vinylpyridine
3-ethyl-5-vinylpyridine
2,6-diethyl-4-vinylpyridine
2-isopropyl-4-nonyl-5-vinylpyridine
2-methyl-5-undecyl-3-vinylpyridine
3-dodecyl-4-vinylpyridine
2,4-dimethyl-5,6-dipentyl-3-vinylpyridine
2-decyl-5-(alpha-methylvinyl)-pyridine
3-(4-pyridyl)-propyl methacrylate
1-(4-pyridyl)-ethyl methacrylate
2-(4-pyridyl)-ethyl acrylate
3-methacryloxypyridine The polymer must contain units of the amino monomer, with at least one other monoethylenically unsaturated monomer having a group of the formula:

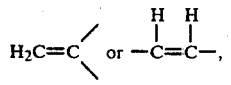

the ratios of the monomers being such that the polymer is water soluble when converted into an organic or inorganic acid salt of the amino component of the polymer.

The preferred polymer of the present invention may be considered to be a polymer comprising units of the formula:

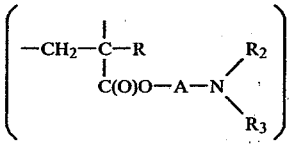

where R is H or methyl, A is a ($C_2$–$C_6$) alkylene group having at least two carbon atoms in a chain between the adjoined O and N atoms or A is a polyoxyethylene group of the formula:

$$-(CH_2CH_2O)_xCH_2CH_2-$$

in which x is from 1 to 11, and $R^2$ and $R^3$ have the meaning given above.

The products are addition polymers. Any known polymerization initiator of free radical type effective in aqueous systems can be used. Examples are tert-butyl hydroperoxide, ammonium persulfate, and alkali metal persulfates, such as those of sodium or potassium. They are at the customary dosage of 0.1 to 2% by weight, based on monomer weight. They may be used with sodium hydrosulfite or other reducing agents in redox systems. The polymerization may be effected by radiation. The amine monomers confer an alkaline pH on the aqueous emulsion being polymerized the pH being 7.5–9, preferably about 8–8.5.

The amine containing monomers are copolymerized with other polymerizable ethylenically unsaturated monomers, especially by emulsion polymerization procedures, using the initiators or redox systems just mentioned in conjunction, if desired, with suitable emulsifiers of nonionic or cationic type. As emulsifiers, there may be used tertoctyl or tert-nonylphenoxy-polyethoxy ethanols having from about 10 to about 50 or more oxyethylene groups, octadecylamine sulfate, cyclohexyldiethyl(dodecyl)amine sulfate, octadecyltrimethylammonium bromide, polyethoxy amines or mixtures of two or more such emulsifiers.

Any addition polymerizable ethylenically unsaturated monomer having a group

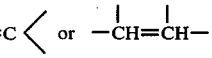

may be used for such copolymerization. Examples of monoethylenically unsaturated monomers include alpha,beta-monoethylenically unsaturated acids, such as acrylic acid, methacrylic acid, itaconic acid, methacryloxy-propionic acid, maleic acid, and fumaric acid; vinyl esters of ($C_1$–$C_{18}$) aliphatic acids, such as vinyl acetate, laurate, and stearate; esters of acrylic acid or methacrylic acid with ($C_1$–$C_{18}$) alcohols, including ($C_1$–$C_{18}$) alkanols, benzyl alcohol, cyclohexyl alcohol, and isobornyl alcohol, such as methyl acrylate or methacrylate, ethyl acrylate or methacrylate, butyl acrylates or methacrylates, 2-ethylhexyl acrylate or methacrylate, octadecyl acrylate or methacrylate, hydroxyethyl methacrylate, hydroxypropyl methacrylate, methoxyethoxyethyl acrylate or methacrylate, ethoxyethoxyethyl acrylate or methacrylate, methoxyethyl acrylate or methacrylate, ethoxyethyl acrylate or methacrylate; vinyl aromatic hydrocarbons including styrene, isopropenyltoluene, and various dialkyl styrenes; acrylonitrile, methacrylonitrile, ethacrylonitrile, and phenylacrylonitrile; acrylamide, methacrylamide, ethacrylamide, N-methylol acrylamide, N-monoalkyl and N-dialkyl acrylamides and methacrylamides, including N-monomethyl, -ethyl, -propyl, -butyl, and N-dimethyl, -ethyl, -propyl, -butyl, and the like, alkaryl amides, including N-monophenyl- and -diphenylacrylamides -methacrylamides, and the like; vinyl ethers, such as butylvinyl ether; N-vinyl lactone such as N-vinyl pyrrolidone; and olefins, such as ethylene, fluorinated vinyl compounds, such as vinylidene fluoride; beta-hydroxyethylacrylate or methacrylate or any of the hydroxyl-containing or amine-containing monomers mentioned in columns 2 and 3 of U.S. Pat. No. 3,150,112 which patent is hereby incorporated by reference; vinylchloride and vinylidene chloride; alkyl vinyl ketones; including methyl vinyl ketone, ethyl vinyl ketone, and methyl isopropenyl ketone; itaconic diesters containing a single ethylenic grouping, including the dimethyl, diethyl, dipropyl, dibutyl and other saturated aliphatic monohydric alcohol diesters of itaconic acid, diphenyl itaconate, dibenzyl itaconate, di(phenylethyl)itaconates; allyl, and methallyl esters of saturated aliphatic monocarboxylic acid including allyl and methallyl esters of saturated aliphatic monocarboxylic acid, including allyl and methallyl acetates, allyl- and methallyl propionates, allyl- and methallyl valerates; vinylthiophene; 4-vinylpyridine; and vinyl pyrrole.

The proportion of (a) unsaturated amines or their salts, calculated as the free amines, relative to (b) the monomers having

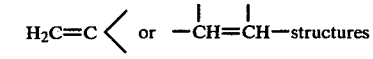

is 10–90 of (a) with 10–90 (b), preferably 10–50 (a) with 50–90, more preferably 20–40 (a) with 60–80 (b), by weight, with the total being 100; this refers to the monomers fed to the polymerization vessel. As noted elsewhere herein, the final polymer contains less amine because of hydrolysis. An example is 35 (a) with 65 (b) with up to 50% of the mer units from (a) being present as hydrolyzed units in the form of COOH groups. At the lower levels of amine, or its salt, it may be necessary to include hydrophilic monomers among those given above, well known to those skilled in the art, to obtain water solubility.

Preferred are polymers in which (a) the amine or its salt is an aminoalkyl ester of at least one of acrylic acid and methacrylic acid, and the monomer (b) is at least one of an ester, amide, or nitrile of the alpha,beta-ethylenically unsaturated carboxylic acids, vinyl aromatic hydrocarbons, vinyl ethers, vinyl lactones, fluorinated vinyl compounds, vinyl and vinylidine halides, vinyl alkanol esters of alkanoic acids, unsaturated ketones, and allyl compounds. Most preferably, at least a major proportion of monomer (b) is at least one of an ester of acrylic acid or methacrylic acid.

Because of the known proclivity of esters to hydrolyze under acidic or basic conditions, there is often a detectable amount of acid mers in emulsion polymers prepared from addition polymerized non-acid monomers. In the case of the polymers of the invention from 1 to 50%, preferably about 5 to 15%, of the amine monomers are hydrolyzed to acid monomers. At the alkaline pH, most other unsaturated esters do not hydrolyze to an appreciable extent. This depends to a large extent upon the polymerization procedure. Using a carefully controlled one-shot redox process, less hydrolysis takes place than using a gradual addition redox process. For instance, using the latter, with copolymers of methyl methacrylate (MMA), ethyl acrylate (EA) and dimethylaminoethyl methacrylate (DMAEMA), it is common to find from 5% to 15% hydrolysis, and even up to 50% hydrolysis is not rare. Other factors enter into the extent of hydrolysis, such as the temperature, length of time the emulsion is stirred before polymerization is started, etc. The hydrolysis is believed to be "autocatalytic"; once some hydrolysis of, say, DMAEMA takes place, the released methacrylic acid (MAA) induces further hydrolysis.

Laboratory prepared latexes give the following results:

| Polymer Composition by weight | Approximate Extent of Hydrolysis of DMAEMA |
|---|---|
| DMAEMA/EA/MMA | |
| 10/50/40 | 55% |
| 20/50/30 | 35% |
| 30/50/20 | 30% |
| 40/40/20 | 30% |
| 50/40/10 | 30% |

The EA and MMA do not hydrolyze to an appreciable extent at the pH provided by the amine in the polymerization procedure. The latex can be applied to the fabric as such, say at a pH of about 8, but is also applied after neutralization with an acid such as acetic acid to a pH of about 7 to give the salt of the amine mers.

Numerous methods of polymerizing (including copolymerizing within the meaning of this term) the amine salts and the corresponding amines in free base form are well known and any of these methods may be used. Conventional emulsion or suspension, bulk, and solution polymerization techniques may be employed.

When polymers in the lower molecular weight range are desired, the polymerization of the amine or its salt, with the other monomers noted, may be effected at elevated temperatures, e.g., 40° to 60° C. or higher in organic solvents using conventional initiator systems. In emulsion polymerizations using initiators such as ammonium persulfate with or without sodium hydrosulfite, mercaptans or other chain transfer agents give the lower molecular weights. The higher molecular weight polymers may be obtained at lower temperatures, such as 5° to 10° C., in organic solvents and using concentrations of 60% or more, with dilution to facilitate handling as polymerization progresses, or if in emulsion polymerization, omitting chain transfer agents, and using low initiator levels.

To prepare polyester fabrics, the polymers hereinabove defined may be applied to the same by the conventional methods used for the purpose, e.g., padding, coating, dipping, bath exhaustion, spraying, etc.

"Polyester" fabrics as used herein mean those consisting essentially of polyester fibers, preferably 100% polyester fibers. For fabrics containing 10% cotton fibers, for example, other, non-amine soil release agents are preferred. The fabrics are well known products, forming no part of the present invention. A typical polyester fiber is sold under the trademark DACRON, a condensation polymer of ethylene glycol and terephthalic acid.

It is to be understood that while no acid monomers were used, up to 50% of the amine monomers were hydrolyzed to give a final polymer having ratios of amine mer and/or a salt thereof: —COOH groups of from 100:1 to 1:1.

EXAMPLE 1

Preparation of Amine-Containing Water Soluble Emulsion Polymer

A 3-liter round bottom flask is fitted with a stirrer, reflux condenser, and nitrogen inlet tube. The flask is charged with 1,500 g. of deionized (DI) water and sparged with nitrogen for one hour. Then, 41.4 g. of Triton X-405 (OPE-40) (70%) and 35.5 g. of 25% sodium lauryl sulfate are charged to the flask. After stirring 15 minutes, 336 g. of methyl methacrylate (MMA) is added in one portion, and the mixture is stirred 10 minutes. A freshly combined mixture of 4.5 g. of 0.1% ferrous sulfate heptahydrate and 6.0 g. of 0.1% "Versene" are then added, followed by 144 g. dimethylaminoethyl methacrylate (DMAEMA). Five minutes after the addition of the DMAEMA, at a kettle temperature of 24° C., 2.4 g. of isoascorbic acid in 97.5 g. of water is added. Within one minute, 3.42 g. of 70% t-butyl hydroperoxide (t-BHP) is added. In two minutes, the temperature reaches 30° C. and the exothermic polymerization gives a peak temperature of 55° C. within 8 minutes. Fifteen minutes after the temperature peaks, 0.24 g. of isoascorbic acid in 15 ml. of water is added, followed by 0.34 g. of t-BHP as a chaser to eliminate residual monomer. Thirty minutes after addition of the chaser, the emulsion is sampled.

Found: solids, 25.2%; pH, 8,5; titer, 0.385 meq/g. at pKa 5.9 and 0.030 meq/g at pKa 9.4.

An 800 g. portion of the polymer emulsion is diluted with 1600 g. of water and heating started. At 50° C., 20.25 g. of acetic acid is added, and the polymer becomes solubilized.

Found: solids 8.4; pH 5.3; viscosity 550 cps. (spindle 3, 60 RPM); titer 0.277 meq/g.

EXAMPLE 2

Preparation of Emulsion Copolymers of Methyl Methacrylate, Ethyl Acrylate, and Dimethylamino Methacrylate, in ratio of 25/45/30 by Weight Example 1 is substantially repeated, adding the EA and MMA before the DMAEMA, and using the monomer ratios indicated.

EXAMPLE 3

Preparation of Low Molecular Weight Amine-Containing Polymer

The procedure outlined in Example 1 is followed except that 4.8 g. of bromotrichloromethane chain transfer agent is added along with the methyl methacrylate charge. The emulsion polymer has a pH of 8.0, a solids content of 25.6%, a titer of 0.407 meq/g. at pKa 5.9 and 0.03 meq/g. at pKa 9.4.

After solubilization with acetic acid as described above, the polymer solution has 8.7% solids, pH 5.3, viscosity 230 cps. and a titer of 0.275 meq/g.

The use of excess catalyst is also useful to reduce molecular weight of the final polymer, as is the use of high temperature solution polymerization, as is well known to those skilled in the art.

EXAMPLE 4

Preparation of Solution Polymer-Containing Amine Groups

A 2-liter round bottom flask is fitted with a stirrer, reflux condenser, nitrogen inlet tube and an addition funnel. Six hundred grams of toluene is charged to the flask and heated to 95° C. Then, at a kettle temperature of 95° C. a mixture of 630 g. of methyl methacrylate, 290 g. of dimethylaminoethyl methacrylate (93% purity ) and 5.4 g. of azobisisobutyronitrile are added over three hours. Finally, 3.6 g. of azobisisobutyronitrile in 300 g. of toluene is added over two hours. The polymer solution is then cooled; solids content of the solution is 49.1%; total amine titer is 0.991 meq/g. An equivalent of acetic acid based on amine titer is added, and toluene is removed by distillation while water is continually added to reduce solids to about 25% solids (actual amine titer is 0.42 meq/g.).

To the soil release polymer, in salt or free amine form in water, optional ingredients such as aminoplasts are added. The amount of water was chosen to provide the desired fabric add-on. Total bath solids were generally in the 0.5–4% range. Fabrics were saturated in the bath solutions and passed through the rolls of a Birch Brothers padder at 1.9 mm/sec (7.6 yd/min) and 206 mPa (30 psi) gauge pressure, two dips, two nips.

Padded fabrics were mounted on pin frames, dried 90° C./5 min., and cured as indicated in the examples. Drying and curing occurred in a forced draft oven.

The fabrics, Testfabrics Style 767, were woven from spun polyester yarns.

Binder add-ons were determined from weights of conditioned (21° C./65% R.H.) fabrics before and after treatment, % add-on=(final fabric wt.—initial fabric wt.) 100/initial fabric wt.

Soil release was measured using AATCC (Americal Assoc. of Textile Chemists and Colorists) Test Method 130–1969, "Soil Release: Oily Stain Release Method." The stain was dirty crankcase motor oil diluted 9/1 with clean unused oil. Fabrics were washed in a Maytag home washing machine, full cycle wash, "hot" (60° C.) water, 236 ml (1 cup) of Orvus (Proctor & Gamble) detergent, and eight terrycloth towels. Fabrics were tested for soil release with no washes before staining and five washes before staining. The latter is a measure of the durability of the fabric treatment to laundering. A fabric sample with a "5" rating has the appearance of complete stain removal; a fabric sample with a "1" rating has the appearance of no stain removal.

EXAMPLE 5

Pad Application of Polymer

This example illustrates pad application of the polymer of Example 2 in acetate salt form, i.e. solubilized. The procedure was used for two fabrics: (a) woven polyester, spun yarn, Testfabrics style 767, and (b) knit polyester, filament yarn.

Soil release ratings were higher on the knit fabric than the woven fabric. Fabric construction influences soil release, so ratings vary of different fabrics, regardless of the soil release agent used.

TABLE I

| | | Pad Application | | | Soil Release Rating | |
|---|---|---|---|---|---|---|
| Fabric | Soil Release Agent | $NaHCO_3$[1] | Cure (°C./min) | Add-on % | Initial | Five Prewashes |
| woven | Ex. 2 | + | 116/5 | 1.1 | 3.8 | 3.7 |
| | | + | 220/1 | 1.1 | 3.9 | 3.7 |
| | | + | 116/5 | 0.6 | 3.6 | 3.7 |
| | | + | 220/1 | 0.6 | 3.6 | 3.1 |
| | none (control) | — | — | — | 2.0 | 1.0 |
| knit | Ex. 2 | — | 116/5 | 0.7 | 5.0 | 4.9 |
| | | — | 220/1 | 0.7 | 5.0 | 4.5 |
| | none (control) | — | — | — | 2.9 | 2.1 |

[1]10% on weight of bath solids

EXAMPLE 6

Polymer in Free Amine Form

Example 5 repeated with the polymer latex of Example 2 in free amine form gave similar results.

EXAMPLE 7

Exhaustion/Application

This example illustrates exhaustion application of the acetate salt of the polymers of Example 2 in a dye bath. All concentrations were % as supplied on weight of fabric. The fabric was woven polyester, spun yarn, Testfabrics style 767.

A 150 mm×150 mm. 2.7 g. fabric sample was placed in a stainless steel Launder-Ometer cylinder, and 15 times the weight of the fabric of water was added. To the container were also added 0.25% Antimussol JK defoamer (Sandoz) and 7.7% the polymer (50 ethyl acrylate/30 dimethylaminoethyl methacrylate/20 methyl methacrylate emulsion copolymer solubilized with acetic acid, 13% solids). Solution pH was adjusted to 6.5 with acetic acid. The container was sealed and mounted in the Launder-Ometer. The Launder-Ometer bath was then heated to 140° F. over a period of 15 minutes. The container was then opened and 8% Dilatin ABM carrier (biphenyl type, Sandoz) and 3% Sandogen J leveling agent (Sandoz) added. The container was sealed and the machine run for 15 minutes. The container was then opened and 0.5% Foron Navy S-ZGRL disperse dye, 200% concentration (Sandoz) added. The container was then sealed again and the bath heated to the boil over a period of about 25 minutes. After running for 15 minutes at the boil the container was removed and cooled. The fabric sample was removed, rinsed in cold water, dried and heat cured 220° C./60 sec. in a forced draft oven.

Another sample was treated in the same manner except no polymer was added. Soil release ratings after five prewashes are shown in Table II.

TABLE II

| | Soil Release Rating Five Prewashes |
|---|---|
| Control | 1.0 |
| With Polymer | 4.2 |

Other polymers prepared similarly to Examples 1 and 2 were tested as above by pad application on woven fabrics with the following results

TABLE II

| EA | MMA | DMAEMA | Initial Release Rating |
|---|---|---|---|
| 50 | 40 | 10 | about 2 |
| 50 | 30 | 20 | 3.4 |
| 50 | 20 | 30 | 3.9 |
| 40 | 20 | 40 | 3.3 |
| 40 | 10 | 50 | 3.2 |

TABLE III

| EA | MMA | DMAEMA | Initial Release Rating | Calculated Tg, °C. |
|---|---|---|---|---|
| 60 | 10 | 30 | 2.0 | 0 |
| 30 | 35 | 35 | 3.2 | 28 |
| 30 | 40 | 30 | 3.4 | 32 |
| 0 | 65 | 35 | 3.5 | 70 |

Table II shows variations in the amounts of DMAEMA, and Table III shows the use of "hard" and "soft" monomers with DMAEMA. Tg is the second order transition temperature, or glass transition temperature, determined at 300 kg/cm$^2$, a well known property. As may be noted, the DMAEMA level, for that monomer combination, is preferably greater than 10%. Surprisingly, the higher Tg polymers, even those which do not form continuous films at room temperature are useful; i.e., Tg is not critical.

It will be understood that in the foregoing examples there was substantial hydrolysis of the amine monomer to give polymers having mer ratios of amine: —COOH groups of between 100:1 and 1:1. Thus, reference to a polymer, for example, of MMA/EA/DMAEMA, means only that only those monomers were fed to the polymerization vessel, the final product of course containing less DMAEMA than was fed.

Other useful polymers prepared similarly include 70 MMA/30 DMAEMA, 45 EA/35 MMA/20 DMAEMA, 80 iBA/20 DMAEMA, and 80 BA/20 DMAEMA. MMA is methyl methyacrylate, iBA is isobutyl acrylate and BA is butyl acrylate.

As indicated above, "amine" as used herein excludes quaternaries. For example, an 80 iBA/20 DMAEMA copolymer, post neutralized with acetic acid and quaternized with epichlorohydrin, was ineffective as a soil release polymer on polyester fabrics. However, small amounts of other polymers used for other functions may be used with the amine-containing polymer without seriously detracting from the efficacy of the soil release polymer.

In order to determine the extent of hydrolysis, the following procedure was followed.

A 10.0 g. sample of latex having about 15% solids was diluted with 10 g. of deionized water and was titrated with 0.5 N HCl on an automatic titrator until excess acid was present, then back titrated with 0.5 N NaOH. The chart was observed to determine breaks for HCl, then poly DMAEMA and poly $CO_2H$ (pKa about 5.1), then dimethylaminoethanol (DMAE) (pKa about 9.6). The acid content of the polymer is equal to the DMAE formed; the amine content of the polymer is calculated by substracting the DMAE formed from the DMAEMA charged.

Acid titers of typical polymers determined by the above-described procedure are as follows:

TABLE IV

| Composition | meq/g. solution DMAEMA charged | DMAE found | Amine content by difference |
|---|---|---|---|
| 50EA/20MMA/30DMAEMA | 0.28 | 0.09 | 0.19 |
| 50EA/30MMA/20DMAEMA | 0.19 | 0.07 | 0.12 |
| 50EA/40MMA/10DMAEMA | 0.09 | 0.05 | 0.04 |
| 50EA/20MMA/27DMAEMA/3MMA | 0.25 | 0.11* | 0.14 |
| 40EA/20MMA/40DMAEMA | 0.37 | 0.10 | 0.27 |
| 40EA10MMA/50DMAEMA | 0.47 | 0.14 | 0.33 |

*total acid titer .11 meq/g. from hydrolysis
.05 meq/g from MAA**
.16 meq/total

**Methacrylic acid

We claim:

1. A method of conferring soil release properties on woven or knit polyester fabrics comprising the steps of incorporating into the fabric, 0.2–10%, solids basis, by weight based on fiber of an aqueous composition of an addition polymer, which is soluble in an aqueous solution when in salt form, having mer units of one or both of the amine or amine salt units of the formulae:

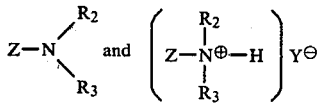

wherein $R_2$ and $R_3$ are H or lower alkyl having 1 to 4 carbon atoms, or together form a cycloaliphatic or cycloaromatic ring having up to 6 carbon atoms, and Z is an addition polymer chain, and containing mer units from at least one monoethylenically unsaturated monomer having a group of the formula

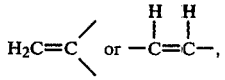

there also being present in the polymer chain pendant —COOH groups in an amount corresponding to a mer ratio in an amount of amine and/or amine salt units: —COOH groups of between 100:1 and 1:1, and drying the polyester fabric.

2. The method of claim 1 in which the polymer comprises units of the formula:

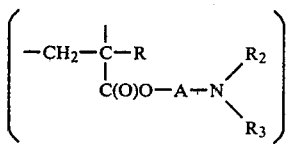

wherein

R is hydrogen or methyl,

A is a ($C_2$–$C_6$) alkylene group having at least two carbon atoms in a chain between the adjoined O and N atoms or A is a polyoxyethylene group of the formula:

$$-(CH_2CH_2O)_xCH_2CH_2-$$

wherein x is from 1 to 11, and

Y is an anion from an acid.

3. The method of claim 1 in which the polyester fabric is woven.

4. The method of claim 1 in which the fabric is knit.

5. The method of claim 1 in which the amine or salt mer units are derived from dimethylaminoethyl (meth-)acrylate.

6. The method of claim 1 in which the amine or salt mer units are derived from tert-butylaminoethyl (meth-)acrylate.

7. The method of claim 2 in which (a) the amine or its salt, each calculated as the free amine, is an aminoalkyl ester of at least one of acrylic acid and methyacrylic acid, and the monomer (b) having one or more of $H_2C{=}C\langle$ and $-\overset{|}{C}H{=}\overset{|}{C}H-$ structures is at least one of an ester, amide, or nitrile of an alpha,-beta-ethylenically unsaturated carboxylic acid, a vinyl aromatic hydrocarbon, a vinyl ether, a vinyl lactone, a fluorinated vinyl compound, a vinyl halide, a vinylidene halide, a vinyl alkanol ester of alkanoic acids, an unsaturated ketone, and an allyl compound, and in which the relative amounts of (a) and (b) are 10–50 (a) with 50–90 (b), with up to 50% of the mer units from (a) being present in the form of COOH units.

8. The method of claim 7 in which at least a major proportion of monomer (b) is at least one of an ester of acrylic acid and methacrylic acid, the relative amounts being 20–40 (a) with 60–80 (b).

9. The method of claim 8 in which the ester is of a $C_1$–$C_4$ alkanol.

10. The method of claim 9 in which the anion is one or more of a halide, nitrate, phosphate, acid phosphate, sulfate, bisulfite, methyl sulfate, carboxylate, sulfonate, sulfamate, acetate, formate, citrate, oxalate, acrylate, and alpha-methacryloxyacetate.

11. The method of claim 10 in which the anion of the amine salt is the acetate, citrate or sulfate.

12. A woven or knit polyester fabric prepared by the method of claim 1, 2, 3, 4, 5, 6, 7, 8, 9, 10 or 11.

* * * * *